US007199088B2

(12) United States Patent
Paggi et al.

(10) Patent No.: US 7,199,088 B2
(45) Date of Patent: Apr. 3, 2007

(54) LUBRICATING OIL FOR A DIESEL POWERED ENGINE AND METHOD OF OPERATING A DIESEL POWERED ENGINE

(75) Inventors: Raymond Edward Paggi, Sugar Land, TX (US); Joseph Michael Russo, Katy, TX (US); Kay Colapret, Lakeway, TX (US); James Robert Macias, Houston, TX (US); Krishna Rangraj Kaushik, Houston, TX (US)

(73) Assignee: Shell Oil Company, Houston, TX (US)

( * ) Notice: Subject to any disclaimer, the term of this patent is extended or adjusted under 35 U.S.C. 154(b) by 715 days.

(21) Appl. No.: 10/602,989

(22) Filed: Jun. 24, 2003

(65) Prior Publication Data

US 2004/0005989 A1 Jan. 8, 2004

Related U.S. Application Data

(60) Provisional application No. 60/392,770, filed on Jul. 1, 2002.

(51) Int. Cl.
*C10M 133/22* (2006.01)

(52) U.S. Cl. ..... 508/386; 123/1 A

(58) Field of Classification Search ..... 508/386
See application file for complete search history.

(56) References Cited

U.S. PATENT DOCUMENTS

| | | | | |
|---|---|---|---|---|
| 2,363,511 | A | 11/1944 | Farrington et al. | 252/39 |
| 3,166,506 | A * | 1/1965 | Zajac | 508/386 |
| 3,255,109 | A * | 6/1966 | Beretvas | 508/184 |
| 3,844,965 | A * | 10/1974 | Brown | 508/221 |
| 3,886,260 | A | 5/1975 | Unland | 423/213.5 |
| 4,080,425 | A | 3/1978 | Tanaka et al. | 423/235 |
| 4,107,272 | A | 8/1978 | Mori et al. | 423/239 |
| 4,208,386 | A | 6/1980 | Arand et al. | 423/235 |
| 4,281,533 | A | 8/1981 | Eesley et al. | 73/15 R |
| 4,313,300 | A | 2/1982 | Wilkes et al. | 60/39.02 |
| 4,601,799 | A | 7/1986 | Froberger et al. | 204/181.8 |
| 4,638,777 | A | 1/1987 | Fanner et al. | 123/277 |
| 4,717,489 | A | 1/1988 | Schieman | 252/32.7 E |
| 4,731,231 | A | 3/1988 | Perry | 423/235 |
| 4,793,306 | A | 12/1988 | Swain | 123/308 |
| 4,800,068 | A | 1/1989 | Perry | 422/173 |
| 4,883,032 | A | 11/1989 | Hunter et al. | 123/276 |
| 4,928,481 | A | 5/1990 | Joshi et al. | 60/737 |
| 4,960,059 | A | 10/1990 | Berkau et al. | 110/347 |
| 5,087,431 | A | 2/1992 | Gardner-Chavis et al. | 423/239 |

(Continued)

FOREIGN PATENT DOCUMENTS

EP 1013750 A2 12/1999

OTHER PUBLICATIONS

"Impact of Fuel and Oil Quantity on Deposits, Wear and Emissions From a Light Duty Diesel Engine With High EGR," SAE Technical Paper Series No. 2000-01-1913, Jun. 22, 2000, XP002257411

*Primary Examiner*—Ellen M. McAvoy

(57) ABSTRACT

A lubricating oil composition useful for a diesel-powered engine is provided that reduces NOx emissions level produced from a diesel-powered engine. The lubricating oil comprises a base oil and at least one oil-dispersible source of HNCO such as isocyanates. A method of operating the diesel powered engine using the lubricating oil is also provided.

41 Claims, 4 Drawing Sheets

U.S. PATENT DOCUMENTS 5,102,566 A 4/1992 Fetterman, Jr. et al. . 252/32.7 E
5,141,657 A 8/1992 Fetterman, Jr. et al. . 252/32.7 E
5,171,462 A 12/1992 DeRosa et al. ..... 252/47
5,171,558 A 12/1992 Gardner-Chavis et al. .. 423/365
5,189,876 A 3/1993 Hirota et al. ..... 60/286
5,199,255 A 4/1993 Sun et al. ..... 60/39.02
5,224,346 A 7/1993 Berriman et al. ..... 60/274
5,233,934 A 8/1993 Krigmont et al. ..... 110/345
5,234,670 A 8/1993 Gardner-Chavis et al. .. 423/235
5,238,589 A 8/1993 Pratt et al. ..... 252/51.5 A
5,264,195 A 11/1993 Turchan ..... 423/235
5,266,083 A 11/1993 Peter-Hoblyn et al. ..... 44/358
5,282,988 A * 2/1994 Farng et al. ..... 508/386
5,290,325 A 3/1994 Kanne et al. ..... 44/400
5,292,351 A 3/1994 DeRosa et al. ..... 44/417
5,320,765 A 6/1994 Fetterman et al. ..... 252/32.7 E
5,330,732 A 7/1994 Ishibashi et al. ..... 423/213.2
5,364,606 A 11/1994 Hung ..... 423/239.2
5,422,085 A 6/1995 Bell et al. ..... 423/213.5
5,426,936 A 6/1995 Levendis et al. ..... 60/278
5,435,283 A 7/1995 Zehr ..... 123/306
5,453,004 A 9/1995 Hofbauer ..... 431/9
5,472,339 A 12/1995 Rakowski et al. ..... 431/171
5,491,256 A 2/1996 Derosa et al. ..... 560/132
5,522,218 A 6/1996 Lane et al. ..... 60/274
5,523,007 A 6/1996 Kristen et al. ..... 252/32.7 E
5,555,853 A 9/1996 Bowen et al. ..... 123/2
5,609,026 A 3/1997 Berriman et al. ..... 60/286
5,661,272 A 8/1997 Iannetti ..... 181/256
5,707,596 A 1/1998 Lewandowski et al. ..... 423/235
5,719,107 A 2/1998 Outten et al. ..... 508/185
5,746,144 A 5/1998 Breen et al. ..... 110/345
5,766,562 A 6/1998 Chattha et al. ..... 423/213.5
5,783,160 A 7/1998 Kinugasa et al. ..... 423/237
5,787,708 A 8/1998 Lane et al. ..... 60/301
5,791,139 A 8/1998 Atago et al. ..... 60/274
5,800,782 A 9/1998 Hagstrom et al. ..... 422/75
5,830,421 A 11/1998 Gardner et al. ..... 423/213.2
5,868,112 A 2/1999 Mahakul et al. ..... 123/263
5,879,645 A 3/1999 Park et al. ..... 423/213.2
5,922,295 A 7/1999 Chattha et al. ..... 423/213.7
5,924,280 A 7/1999 Tarabulski ..... 60/274
5,960,777 A 10/1999 Nemser et al. ..... 123/585
5,980,844 A 11/1999 Kharas ..... 423/213.2
6,001,152 A 12/1999 Sinha ..... 95/58
6,003,303 A 12/1999 Peter-Hoblyn et al. ..... 60/274
6,004,910 A 12/1999 Bloch et al. ..... 508/294
6,016,653 A 1/2000 Glassey et al. ..... 60/274
6,038,854 A 3/2000 Penetrante et al. ..... 60/297
6,056,793 A 5/2000 Suppes ..... 44/446
6,074,973 A 6/2000 Lambert et al. ..... 502/60
6,093,378 A 7/2000 Deeba et al. ..... 423/213.5
6,159,911 A 12/2000 Katafuchi ..... 508/391
6,161,378 A 12/2000 Hanaoka et al. ..... 60/286
6,165,934 A 12/2000 Gardner et al. ..... 502/330
6,174,842 B1 1/2001 Gatto et al. ..... 508/364
6,202,407 B1 3/2001 Brusasco et al. ..... 60/274
6,206,949 B1 3/2001 Kobayashi et al. ..... 75/460
6,213,105 B1 4/2001 Banzhaf et al. ..... 123/568.12
6,227,221 B1 5/2001 Schmitz ..... 137/1
6,230,683 B1 5/2001 zur Loye et al. ..... 123/435
6,248,684 B1 6/2001 Yavuz et al. ..... 502/66
6,274,029 B1 8/2001 Wittenbrink et al. ..... 208/15
6,276,334 B1 8/2001 Flynn et al. ..... 123/435
6,286,482 B1 9/2001 Flynn et al. ..... 123/435
6,296,757 B1 10/2001 Wittenbrink et al. ..... 208/15
6,348,178 B1 2/2002 Sudduth et al. ..... 423/235

* cited by examiner

LUBRICATING OIL FOR A DIESEL POWERED ENGINE AND METHOD OF OPERATING A DIESEL POWERED ENGINE

This application claims the benefit of U.S. Provisional Application No. 60/392,770 filed Jul. 1, 2002, the entire disclosure of which is hereby incorporated by reference.

FIELD OF THE INVENTION

This invention relates to the reduction of $NO_x$ emissions from a diesel powered engine and lubricating oil compositions useful for such diesel-powered engine.

BACKGROUND OF THE INVENTION

Diesel engine manufacturers are continuously challenged to meet lower emission standards set forth by the U.S. Environmental Protection Agency (EPA), as well as other such agencies worldwide. These standards for both diesel and gasoline engines mandate limits for unburned hydrocarbons, carbon monoxide and nitrogen oxides ($NO_x$). Current U.S. regulations for diesel engine emissions allow $NO_x$ emissions of only 4.0 g/bhp-hr. This will be reduced for the 2004 Model Year to a standard of 2.5 g/bhp-hr combined $NO_x$ and non-methane hydrocarbons emissions.

The undesirability of $NO_x$ compounds and their ability to further react to produce additional undesirable materials make them an undesirable by-product from the burning of hydrocarbons. These NOx compounds and their derivative reaction products comprise what is commonly referred to as "smog."

Many methods have been used or suggested to reduce or eliminate $NO_x$. A number of these rely upon reaction of $NO_x$ in the effluent exhaust gas in a system containing a reducing agent. Reducing agents such as ammonia, urea, and cyanuric acid have been used to selectively reduce $NO_x$ ($NO+NO_2$) in the exhaust gas streams.

The $NO_x$ reduction steps in a effluent exhaust gas system can take place at low temperature over a catalyst, referred to as selective catalytic reduction (SCR), or at high temperature without the aid of a catalyst (selective non-catalytic reduction, or SNCR).

A recent example of SCR can be found in U.S. Pat. No. 6,203,770 B1. This patent describes the pyrolysis of urea ($CO(NH_2)_2$) in a chamber generating ammonia ($NH_3$) and isocyanic acid (HNCO). These components are then mixed with $NO_x$ containing exhaust gases from a diesel engine and contacted with an SCR catalyst resulting in the reduction of $NO_x$ compounds.

Some in-cylinder technologies for reducing $NO_x$ have also been developed, such as exhaust gas recirculation. One way of implementing this method involves recirculating a portion of the exhaust gases back through the engine using pressure pulses created by the exhaust valves. The exhaust gases go through a cooler before being introduced back into the engine through the inlet. These gases dilute the air/fuel charge thereby lowering peak combustion temperatures and lowering $NO_x$ emissions.

All of these technologies require the design and implementation of additional systems for the exhaust gas, which increases costs and complexity, while often reducing engine efficiency.

Another limitation, that involves the SNCR method, is the requirement of a very high temperature, much higher than typical diesel exhaust gas temperatures.

It would be very advantageous to find a method of reducing problematic $NO_x$ emissions from a diesel engine that would not require expensive modifications to the exhaust system of diesel engines.

SUMMARY OF THE INVENTION

A lubricating oil composition useful for diesel engine is provided comprising: a base oil; and at least one oil-dispersible source of HNCO in an amount effective to reduce NOx emission from a diesel engine compared to a lubricating oil composition without the source of HNCO.

Also provided is a lubricating oil composition useful for diesel engine comprising: a base oil; and at least one isocyanate having sufficient volatility to degas from the lubricating oil composition under normal engine operating conditions in an amount effective to reduce NOx emission from a diesel engine compared to a lubricating oil composition without the isocyanate.

Further provided is a method of operating a diesel engine comprising:

introducing into the diesel engine a lubricating oil composition; and operating the engine, wherein the lubricating oil composition comprises a base oil, and at least one oil-dispersible source of HNCO in an amount effective to reduce NOx emission from a diesel engine compared to a lubricating oil composition without the source of HNCO.

Yet further provided is a method of operating a diesel engine comprising: an engine body; a combustion chamber formed in the engine body for containing a mixture of fuel and air; a plurality of cylinders formed in the engine body; and a respective piston mounted in each of said plurality of cylinders for reciprocal movement through successive exhaust and intake strokes, each respective piston defining a combustion chamber for containing a mixture of fuel and air the method comprising:

introducing, into the combustion chamber, diesel fuel and air;

delivering a lubricating oil composition to the cylinders;

compressing the diesel fuel in the combustion chamber to ignition with the piston thereby producing an exhaust gas containing NOx;

wherein the lubricating oil composition comprises a base oil and at least one oil-dispersible source of HNCO.

BRIEF DESCRIPTION OF THE DRAWINGS

Advantages of the present invention will become apparent to those skilled in the art with the benefit of the following detailed description of embodiments and upon reference to the accompanying drawings in which.

DETAILED DESCRIPTION OF THE INVENTION

Figure 1:
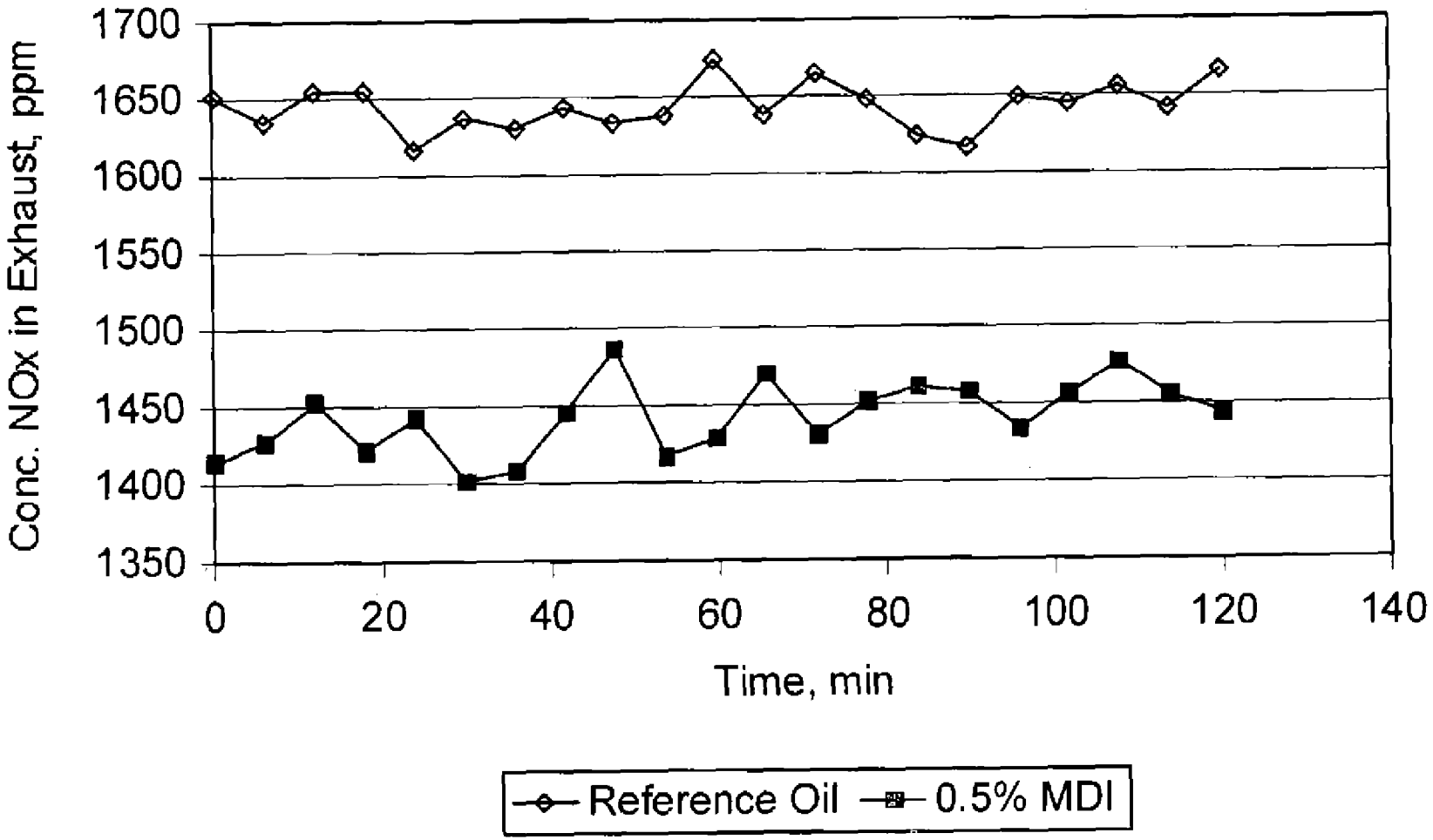
FIG. 1 is a plot of $NO_x$ emissions versus time for comparative oil and one within the scope of this invention.

The invention reduces exhaust $NO_x$ emissions in a diesel fuel engine. One aspect of the invention relates to the reduction of $NO_x$ from the exhaust of diesel fuel engines via a $NO_x$ reducing agent introduced via the lubricating oil. The term "diesel fuel engine" or "diesel engine" includes all compression-ignition engines, for both mobile purposes (including marine) and stationary purposes (such as power plants) and of the two-stroke per cycle, four-stroke per cycle and rotary types. The term "diesel fuel" means "distillate fuels" including diesel fuels meeting the ASTM definition for diesel fuels or other fuels even though they are not wholly comprised of distillates and can comprise alcohols, ethers, organo-nitro compounds and the like (e.g., methanol, ethanol, diethyl ether, methyl ether, nitro methane). The term "distillate fuel" means all of those products prepared by the distillation of petroleum or petroleum fractions and residues. The term "petroleum" is meant in its usual sense to include all of those materials regardless of source normally included within the meaning of the term, including hydrocarbon materials, regardless of viscosity, that are recovered from fossil fuels. The term "diesel oil" is meant to include any motor oil or lubricating oil suitable for use in a diesel engine.

According to the invention, a novel method is disclosed which reduces $NO_x$ emissions from a diesel fuel engine. The method involves adding a novel diesel oil composition to the diesel engine, and then running the engine under normal operating conditions. It has been found that introduction of $NO_x$ reduction species directly into the combustion chamber, would allow reaction of $NO_x$ and reducing species in the presence of sufficiently high temperatures.

Accordingly, a lubricating oil composition useful for diesel engine is provided containing: a base oil; and at least one source of HNCO in an amount effective to reduce NOx emission from a diesel engine compared to a lubricating oil without the source of HNCO. The source of HNCO is preferably dispersible in the lubricating oil composition. The term "dispersible" means that the source of HNCO can be distributed throughout the lubricating oil matrix whether it is soluble, colloidal or suspended. The source of HNCO preferably is an isocyanate having sufficient volatility to degas from the lubricating oil composition under normal engine operating conditions. The term "sufficient volatility to degas" can be the isocyanate in its original form or at least one of its decomposition components. Decomposition components can be the isocyanate, or the source of HNCO, where at least a portion is cleaved to release the cyanogen functionality (NC) under normal operating conditions found in the combustion chamber of the engine. Examples of preferable isocyanates include compounds represented by the formula:

$$R—(N{=}C{=}O)_x$$

wherein R represents a hydrocarbyl group having 4 to 30 carbon atoms, hydrocarbyl group being preferably alkyl, aryl, or arylalkyl group, and x is an integer of 1 to 4, more preferably 1 or 2. Most preferably the isocyanate is methylene diphenyl diisocyanate.

The source of HNCO or isocyanate is present in an amount of at least about 0.1% by weight, preferably at least about 0.5% by weight, more preferably at least about 1.0% by weight based on the total weight of the lubricating oil composition. Practically, the source of HNCO or isocyanate may be present in an amount where the lubricating oil is effective for its intended purpose as a lubricant that is in an amount of up to about 5% by weight based on the lubricating oil composition Preferably the lubricating oil composition is substantially free of compounds reactive with the HNCO or isocyanates to a level that the source of HNCO or isocyanates is available to reduce the NOx level generated at the engine. The presence of HNCO can be detected by known analytical methods including spectroscopic methods known to those skilled in the art.

The base oil component of this invention may be selected from any of the synthetic (lubricating) oils or natural oils or mixtures thereof. Base oils may be classified as Group I, Group II, Group II+, Group III, and Group IV base oils as known to those skilled in the art. In certain instances, usually depending on the final use of the lubricant composition according to the present invention, Group I is preferred, in some instances Group II+ are preferred, and in other instances, Group II and III are preferred.

Typically, group I base oils contain less than 90% saturates (as determined by ASTM D 2007) and/or greater than 0.03 percent sulfur (as determined by ASTM D 2622, D 4294, D 4927, or D 3120) and have a viscosity index greater than or equal to 80 and less than 120 (as determined by ASTM D 2270). Typically group II base oils contain greater than or equal to 90% saturates and less than or equal to 0.03% sulfur and have a viscosity index greater than 80 and less than 120 using the above noted test methods. Group II+ base oils may have a VI at the high end of the VI spectrum, e.g., about 120. Typically, Group III base oils contain greater than or equal to 90 percent saturates and less than or equal to 0.03% sulfur and have a viscosity index greater than or equal to 120 using the tests noted above. Typically group IV base oils are polyalphaolefins (PAO).

The base oils may conveniently have a viscosity of about 3.8 Centistokes ($mm^2/s$) at 100 degree C. to 26 Centistokes ($mm^2/s$) at 100 degree C.

Natural oils include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters formed by reacting dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as, the polyalkyl-, polyaryl-, polyalkoxy, or polyaryloxysiloxane oils and silicate oils comprise another useful class of synthetic lubricating oils; they include tetraethyl silicate, tetraisopropyl silicate, tetra-(2-ethylhexyl) silicate, tetra-(4-methyl-2-ethyl-hexyl) silicate, tetra-(p-tertbutylphenyl) silicate, hexa-(4-methyl-2-pentoxy) disiloxane, poly(methyl)siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

These lubricating oil compositions may typically contain other additives such as oxidation inhibitors (antioxidants), dispersants, and/or detergents. The lubricating oil compositions may also include other lubricant additives that perform specific functions not provided by the main components. These additional additives include, but not limited to, corrosion inhibitors, viscosity index improvers (or modifiers), pour point depressants, zinc dialkyldithiophosphates, anitwear agents, anti-foam agents, and/or friction modifiers. Suitable additives are described in U.S. Pat. Nos. 5,320,765 and 6,528,461, the disclosures of which are hereby incorporated by reference in their entirety. Suitable oxidation inhibitors include, for example, copper antioxidants phenolic compounds, and/or aminic compounds. Suitable dispersants include, for example, succinimides. Suitable detergents include, for example, one or more salicylate, phenate, and/or sulfonate detergents.

The diesel engine typically comprise: an engine body; a combustion chamber formed in the engine body for containing a mixture of fuel and air; an intake air system for delivering intake air, including at least one of air and a mixture of air and fuel, to said combustion chamber; an exhaust gas system for directing exhaust gas that may contain air and the combustion products of fuel from said combustion chamber; a fuel supply system connected to the engine for directing fuel into at least one of said intake air system and said combustion chamber; a plurality of cylinders formed in the engine body, said cylinders comprising an inner edge; a respective piston mounted in each of said plurality of cylinders for reciprocal movement through successive exhaust and intake strokes, each respective piston defining a combustion chamber for containing a mixture of fuel and air, said piston having piston rings that provide sliding seal between the outer edge of the piston and the inner edge of the cylinders; a respective rotatable crankshaft operatively connected to said respective piston for reciprocal movement through a top dead center position as such delivers power to the drive train; and a sump (crankcase) formed in the engine body for containing a lubricating oil and surrounding said crankshaft. The cylinders contain an inner wall (or inner edge) and an outer wall where the inner circumferential wall surrounds the piston. The piston rings typically are present to prevent the fuel/air mixture and exhaust in the combustion chamber from leaking into the sump during compression and combustion and to keep lubricating oil in the sump from leaking into the combustion area. The combustion chamber is where the combustion and compression takes place. As the piston moves up and down the cylinder, the volume of the combustion chamber changes defining the maximum volume and minimum volume of the combustion chamber (expansion and/or compression strokes). The combustion event occurs during the compression and/or expansion strokes.

In the method of the instant invention, a method of operating a diesel engine such as described above comprising an engine body; a combustion chamber formed in the engine body for containing a mixture of fuel and air; a plurality of cylinders formed in the engine body, said cylinders comprising an inner edge; a respective piston mounted in each of said plurality of cylinders for reciprocal movement through successive exhaust and intake strokes, each respective piston defining a combustion chamber for containing a mixture of fuel and air is provided that reduce NOx emission levels from the diesel engine the method comprising:

introducing, into the combustion chamber, diesel fuel and air;

delivering a lubricating oil composition to the cylinders;

compressing the diesel fuel in the combustion chamber to ignition with the piston thereby producing (generating) an exhaust gas containing NOx;

wherein the lubricating oil composition comprises a base oil and at least one oil-dispersible source of HNCO. The source of HNCO is preferably an isocyanate having sufficient volatility to degas from the lubricating oil composition under normal engine operating conditions.

In general, pressures in the range from about 500 psi to about 1000 psi can be reached at the end of the compression stroke. Through the compression process, the air can be heated up to about 537° C. (1000° F.) or higher, which is high enough to spontaneously ignite the fuel as it is injected into the cylinders. Temperatures of the combustion gases following ignition of the fuel are higher, rising as high as about 1600° C. (2912° F.) a few crank-angle degrees after ignition of the fuel. The cylinder is typically heated during such engine operating conditions to a temperature in the range of about 300° F. (149° C.) to about 500° F. (260° C.).

Without limiting the invention by any certain theory, it is theorized that a $NO_x$ reducing component degasses from the oil proximate and/or on the inner edge of the cylinders while the engine is operating (at the temperature of the cylinders) and reacts with the combustion gas. It has been found that when the source of HCNO is added to the lubricating oil, the concentration of $NO_x$ emissions in the exhaust gases of a diesel engine is reduced compared to emissions from the same diesel engine operated with a reference oil without the source of HCNO. The lubricating oil is introduced into the sump or crankcase. The lubricating oil contained in the bottom of the sump is generally delivered to the cylinders that may be deposited proximately and/or on the inner edge of the cylinders by means of the crankshaft and the piston.

While the invention is susceptible to various modifications and alternative forms, specific embodiments thereof are shown by way of example in the drawings and herein described in detail. It should be understood, that the drawings and detailed description thereto are not intended to limit the invention to the particular form disclosed, but on the contrary, the intention is to cover all modifications, equivalents and alternatives falling within the spirit and scope of the present invention as defined by the appended claims. The present invention will be illustrated by the following illustrative embodiment, which is provided for illustration only and is not to be construed as limiting the claimed invention in any way.

EXAMPLES

Test runs to evaluate lubricating engine oil compositions for reducing $NO_x$ emissions were performed using an industry standard diesel powered test engine.

Test Equipment: A Caterpillar® single cylinder oil test engine (SCOTE) was used to evaluate the diesel engine oil compositions. The SCOTE engine did not have any catalytic converters or any apparatus to lower $NO_x$ emissions. The exhaust system was modified to accommodate a zircoia $NO_x$ sensor, the signal of the sensor was inputed to a portable $NO_x$ meter (e.g., Horiba $NO_x$ meter, Japan).

The evaluation tests were conducted using the following lubricating oil composition and fuel.

Test Oil/Fuel: A commercially available, fully formulated 15W40 diesel engine oil was used as reference oil. A test lubricating composition was prepared by combining a commercially available, fully formulated, 15W40 diesel engine oil with 0.5 % by weight of an isocyanate, methlyene diphenyl diisocyante (MDI) (Dow Chemical Company, Midland Mich.), based on the weight of the lubricating composition. Fuel for the test runs was an ASTM reference diesel fuel.

The evaluation tests were conducted according to the following procedure.

Test Description: A modified CAT 1P ASTM test method was performed to generate NOx emissions. Stages 4 and 5 of the CAT 1P ASTM test method were run for two hours. $NO_x$ emissions were measured during the testing period every 6 minutes. The $NO_x$ emissions data were recorded using the SCOTE test system data logger. All test runs were performed in duplicate and the data were averaged. Results from the evaluation testing are graphically depicted in FIGS. 1 and 2. FIG. 1 is a graphical representation of $NO_x$ emissions versus time for the reference oil and the test lubricating oil composition containing 0.5 wt. % of MDI, based on the weight of the lubricating oil composition. The results as shown in FIG. 1 demonstrate that the MDI containing lubricating oil composition significantly reduces $NO_x$ emissions generated by a single cylinder diesel engine. $NO_x$ emissions were reduced to 1450 parts per million (ppm) from a level of 1645 ppm for the reference oil.

Figure 2:
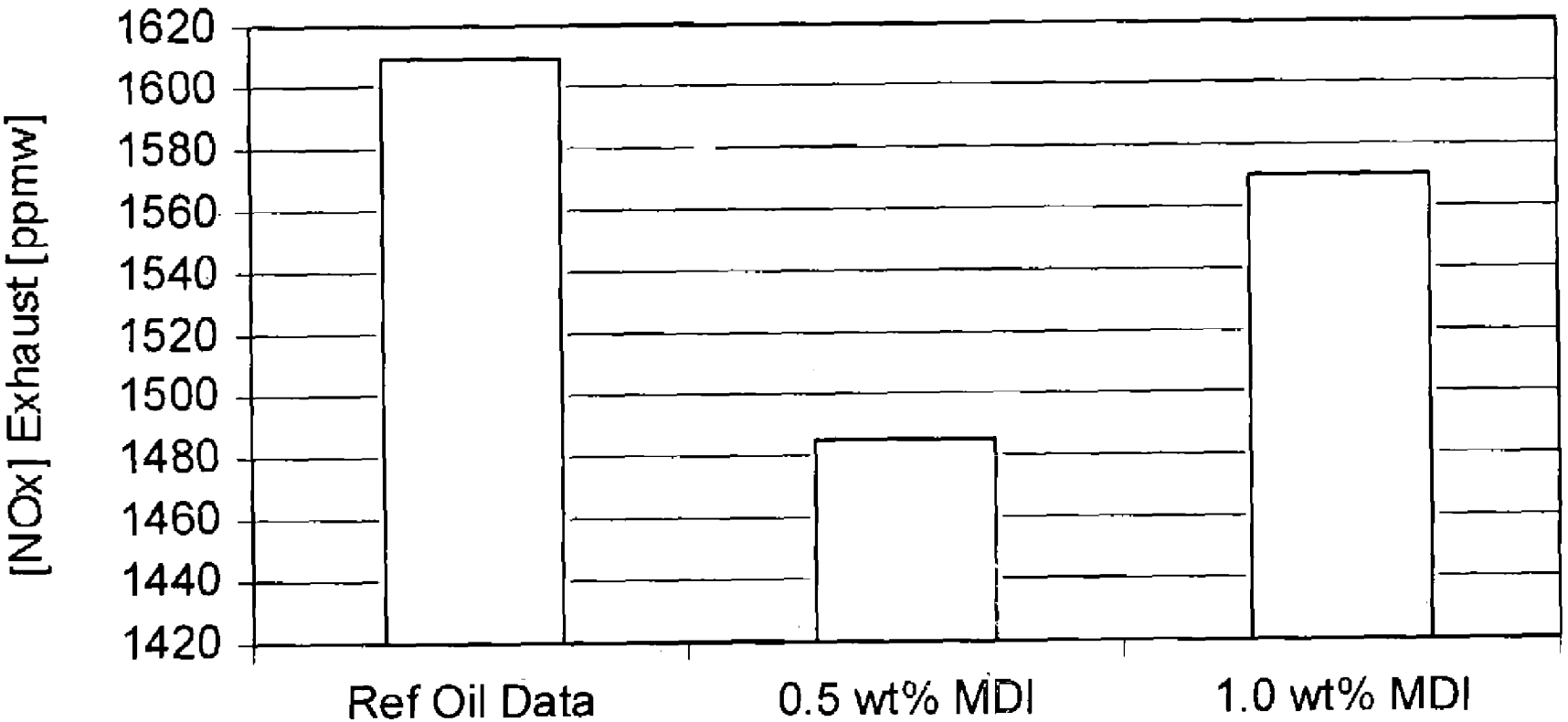
FIG. 2 is a graph of $NO_x$ emissions averaged over several experimental runs for comparative oil and also for an oil within the scope of the invention at two different treatment levels.

Subsequent tests were conducted to evaluate the effect of different MDI concentrations on $NO_x$ emissions using the same procedure, engine, fuel and reference oil described for FIG. 1. The test lubricating oil compositions for the subsequent testing were prepared by combining commercially available, fully formulated, 15W40 motor oil meeting API standards with at 0.5 wt. % of an isocyanate, MDI, or 1.0 wt. % of an isocyanate, MDI, based on the weight of the lubricating oil composition. FIG. 2 shows the average of fifteen runs for the reference oil, 1611 ppm $NO_x$, the average of five runs for the test lubricating oil composition containing 0.5% by weight MDI, 1486 $NO_x$, and the average of two runs with the test lubricating oil composition containing 1.0% by weight MDI, 1573 ppm. $NO_x$ emission data for the reference oil is tabulate in Table I. $NO_x$ emission data for the test lubricating oil composition at 0.5% by weight is tabulated in Table II. $NO_x$ emission data for the test lubricating oil composition at 1.0% by weight is tabulated in Table III.

TABLE I

| $NO_x$ Emissions When Using Reference Oil | |
|---|---|
| Test Run | $NO_x$ in exhaust (ppmw) |
| 1 | 1563 |
| 2 | 1645 |
| 3 | 1523 |
| 4 | 1648 |
| 5 | 1576 |
| 6 | 1570 |
| 7 | 1597 |
| 8 | 1696 |
| 9 | 1656 |
| 10 | 1668 |
| 11 | 1559 |
| 12 | 1572 |
| 13 | 1694 |
| 14 | 1545 |
| 15 | 1646 |
| Average | 1611 |

TABLE II

| $NO_x$ Emissions When Using Oil Containing 0.5% by Weight of MDI | |
|---|---|
| Test Run | $NO_x$ in exhaust (ppmw) |
| 1 | 1440 |
| 2 | 1429 |
| 3 | 1482 |
| 4 | 1463 |
| 5 | 1615 |
| Average | 1486 |

TABLE III

| $NO_x$ Emissions When Using Oil Containing 1.0% by Weight of MDI | |
|---|---|
| Test Run | $NO_x$ in exhaust (ppmw) |
| 1 | 1495 |
| 2 | 1650 |
| Average | 1573 |

Further tests were conducted using a commercially available diesel powered truck engine.

Test Equipment: A 2000 model year Ford F-250, three-quarter ton pick up truck was used to evaluate the test oils. The test vehicle is powered by a 7.3L Navistar V-8 diesel engine, coupled to a four speed automatic transmission. This vehicle meets original equipment manufacturers specifications, and thus does not utilize catalytic exhaust converters or an exhaust gas recycling system. The exhaust system was modified slightly to accommodate a zirconia NOx sensor, the signal of which was input to a portable Horiba NOx meter. A Campbell Scientific data logger was used to record NOx data.

The tests were conducted using the following test oil and fuel.

Test Oil/Fuel: A reference oil and a lubricating oil composition were evaluated in the diesel powered truck engine. Reference oil was a commercially available, fully formulated 15W40 diesel engine oil. The test lubricating oil composition was prepared by combining a commercially available, fully formulated 15W40 diesel engine oil with 0.5% by weight (5000 ppm) of methylene diphenyl diisocyanate (MDI) based on the weight of the lubricating oil composition according to the invention. The reference oil was used to establish a baseline reference for NOx emissions. The test lubricating oil composition was evaluated relative to the resultant NOx emission levels obtained with the reference oil. The program test fuel was a low sulfur #2 diesel fuel.

The tests were conducted according to the following procedure.

Figure 3:
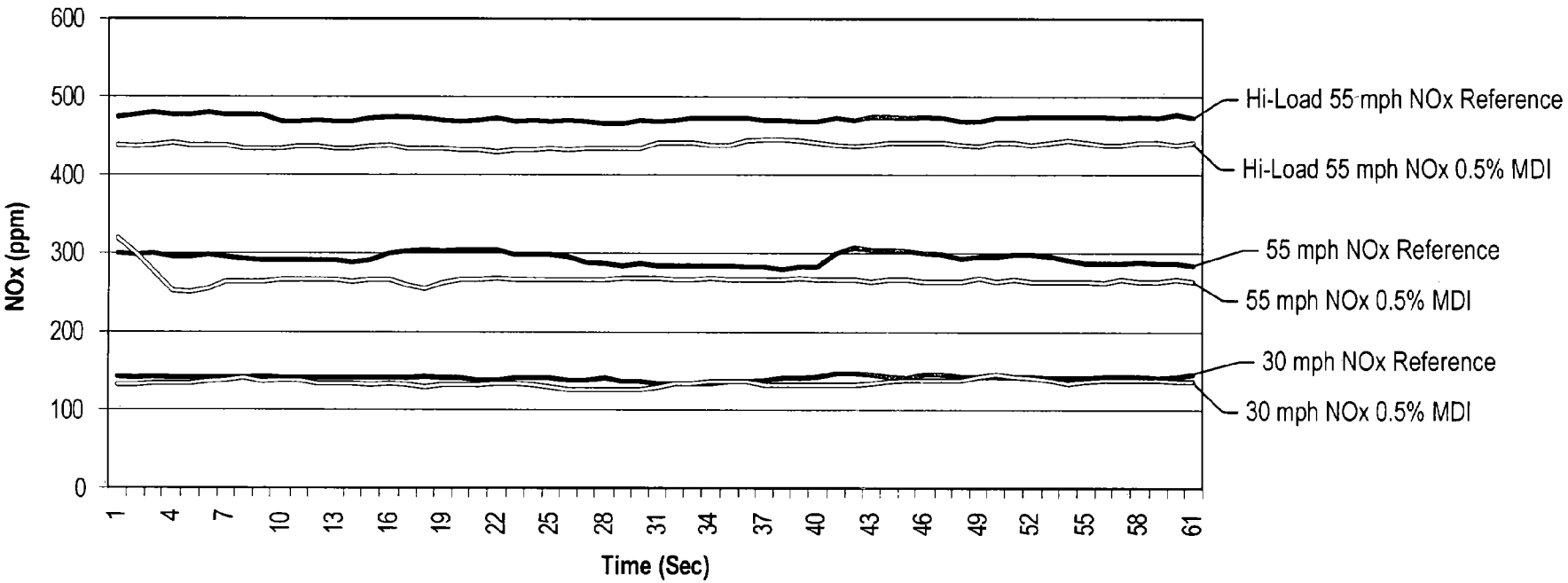
FIG. 3 is a plot of NOx emissions for engine tests at 30 and 55 mph steady state speeds for reference oil and oil within the scope of the invention.
Figure 4:
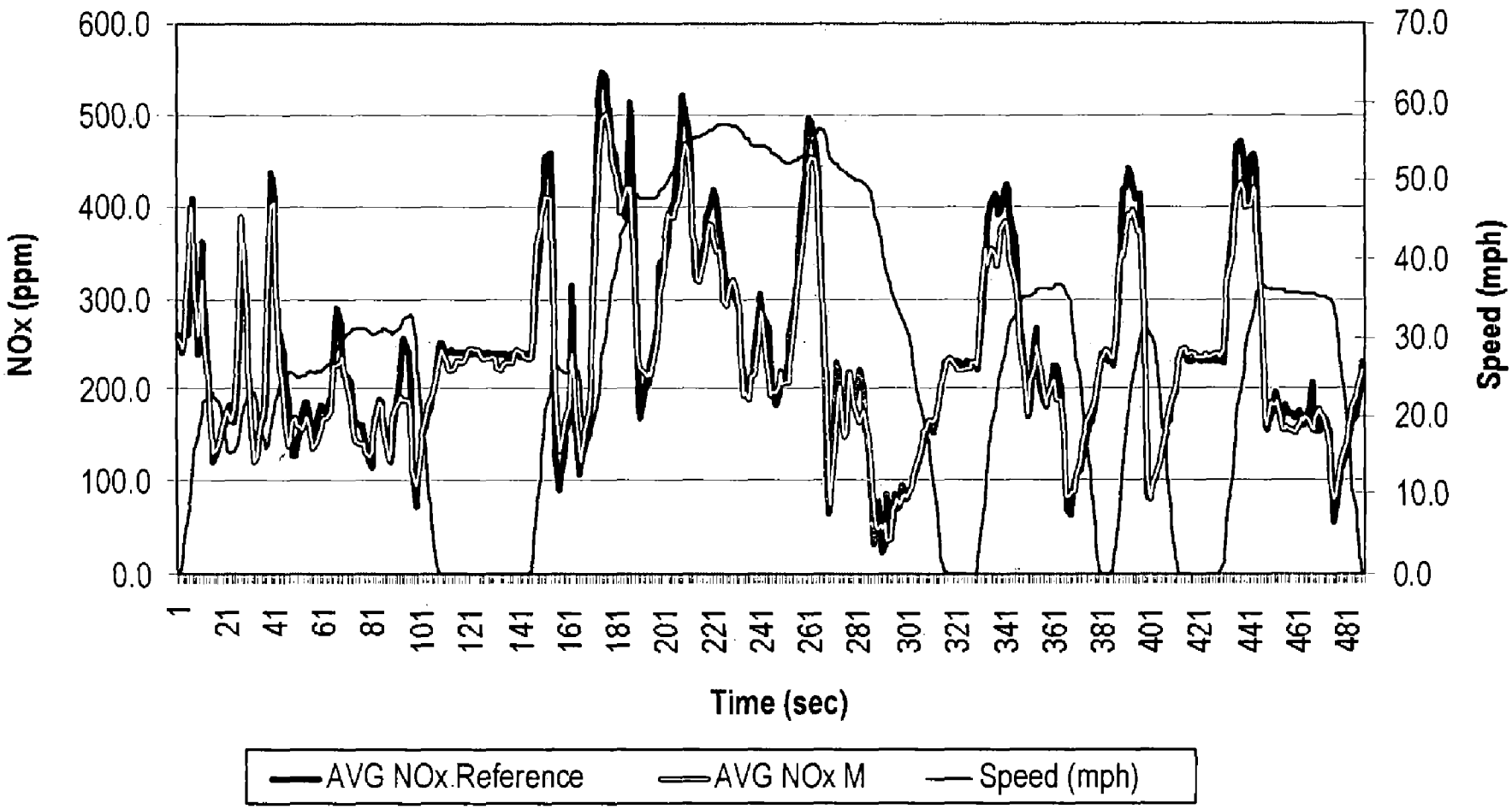
FIG. 4 is a plot of NOx emissions for engine tests at various speeds for reference oil and oil within the scope of the invention.

Test Description: Test oils were "aged" by accumulating approximately 400 over-the-road test miles on the vehicle. The test vehicle was operated on a chassis dynamometer at several conditions including the EPA-505 test cycle, steady state operation at 30 & 55 mph@ level road load and 55 mph@ increased load (2.5% road grade). NOx emissions were measured using a portable Horiba NOx meter and data were downloaded into a data logger. Three test runs were conducted at each condition on each oil. The results of the steady state operations are provided in FIG. 3. The increased load is designated as Hi-load. The result of the EPA-505 test cycle is provided in FIG. 4.

The invention claimed is:

1. A lubricating oil composition comprising:

a base oil suitable for lubricating a diesel engine; and dispersed in said base oil an amount of an isocyanate effective to reduce NOx emission from a diesel engine as compared to a lubricating oil without said isocyanate.

2. The lubricating oil composition of claim 1 wherein the isocyanate is present in an amount of at least about 0.1% by weight based on the weight of the lubricating oil composition.

3. The lubricating oil composition of claim 1 wherein the isocyanate is present in an amount of at least about 0.5% by weight based on the weight of the lubricating oil composition.

4. The lubricating oil composition of claim 1 wherein the isocyanate is a compound represented by the formula:

$$R\text{-}(N{=}C{=}O)_x$$

wherein R is a hydrocarbyl group having 4 to 30 carbon atoms, and x is an integer of 1 to 4.

5. The lubricating oil composition of claim 4 wherein the isocyanate is present in an amount of at least about 0.1% by weight based on the weight of the lubricating oil composition.

6. The lubricating oil composition of claim 5 wherein the isocyanate is present in an amount of at least about 0.5% by weight based on the weight of the lubricating oil composition.

7. The lubricating oil composition of claim 1 wherein the isocyanate is methylene diphenyl diisocyanate.

8. The lubricating oil composition of claim 4 wherein x is 1 or 2.

9. The lubricating oil composition of claim 5 wherein x is 1 or 2.

10. The lubricating oil composition of claim 1 further comprising an additive selected from the group consisting of oxidation inhibitors, dispersants, detergents, and mixtures thereof.

11. A lubricating oil composition useful for lubricating a diesel engine comprising: a base oil; and at least one isocyanate having sufficient volatility to degas from the lubricating oil composition under normal engine operating conditions in an amount effective to reduce NOx emission from a diesel engine as compared to a lubricating oil without the isocyanate.

12. The lubricating oil composition of claim 11 wherein the isocyanate is present in an amount of at least about 0.1% by weight based on the weight of the lubricating oil composition.

13. The lubricating oil composition of claim 12 wherein the isocyanate is present in a amount of at least about 0.5% by weight based on the weight of the lubricating oil composition.

14. The lubricating oil composition of claim 11 wherein the isocyanate is a compound represented by the formula:

$$R\text{-}(N{=}C{=}O)_x$$

wherein R is a hydrocarbyl group having 4 to 30 carbon atoms, and x is an integer of 1 to 4.

15. The lubricating oil composition of claim 14 wherein the isocyanate is present in an amount of at least about 0.1 % by weight based on the weight of the lubricating oil composition.

16. The lubricating oil composition of claim 15 wherein the isocyanate is present in an amount of at least about 0.5% by weight based on the weight of the lubricating oil composition.

17. The lubricating oil composition of claim 14 wherein x is 1 or 2.

18. The lubricating oil composition of claim 15 wherein x is 1 or 2.

19. The lubricating oil composition of claim 11 wherein the isocyanate is methylene diphenyl diisocyanate.

20. The lubricating oil composition of claim 12 wherein the isocyanate is methylene diphenyl diisocyanate.

21. The lubricating oil composition of claim 11 further comprising an additive selected from the group consisting of oxidation inhibitors, dispersants, detergents, and mixtures thereof.

22. A method of operating a diesel engine comprising:

introducing into the diesel engine a lubricating oil composition; and operating the engine, wherein the lubricating oil composition comprises a base oil and at least one isocyanate present in an amount effective to reduce NOx emission from a diesel engine compared to a lubricating oil without the isocyanate.

23. The method of claim 22 wherein the isocyanate is a compound represented by the formula:

$$R\text{-}(N{=}C{=}O)_x$$

wherein R is a hydrocarbyl group having 4 to 30 carbon atoms, and x is an integer of 1 to 4.

24. The method of claim 22 wherein the isocyanate is present in an amount of at least about 0.1% by weight based on the weight of the lubricating oil composition.

25. The method of claim 22 wherein the isocyanate is methylene diphenyl diisocyanate.

26. A method of operating a diesel engine comprising: an engine body; a combustion chamber formed in the engine body for containing a mixture of fuel and air; a plurality of cylinders formed in the engine body; and a respective piston mounted in each of said plurality of cylinders for reciprocal movement through successive exhaust and intake strokes, each respective piston defining a combustion chamber for containing a mixture of fuel and air the method comprising:

introducing, into the combustion chamber, diesel fuel and air;

delivering a lubricating oil composition to said cylinders; and compressing the diesel fuel in the combustion chamber to ignition with the piston thereby generating an exhaust gas containing NOx;

wherein the lubricating oil composition comprises a base oil and at least one isocyanate.

27. The method of claim 26 wherein the isocyanate has sufficient volatility to degas from the lubricating oil composition under normal engine operating conditions.

28. The method of claim 26 wherein the isocyanate is a compound represented by the formula:

$$R\text{-}(N{=}C{=}O)_x$$

wherein R is a hydrocarbyl group having 4 to 30 carbon atoms, and x is an integer of 1 to 4.

29. The method of claim 28 wherein the isocyanate is present in an amount of at least about 0.1% by weight.

30. The method of claim 28 wherein the isocyanate is present in an amount of at least about 0.5% by weight.

31. The method of claim 28 wherein the isocyanate is methylene diphenyl diisocyanate.

32. The method of claim 26 in which the isocyanate is present in an amount of at least 0.1% by weight based on the lubricating oil composition.

33. The method of claim 26 in which the isocyanate is present in an amount of at least 0.5% by weight based on the lubricating oil composition.

34. The method of claim 27 in which the isocyanate is present in an amount of at least 0.1% by weight based on the lubricating oil composition.

35. The method of claim 28 wherein x is 1 or 2.

36. A lubricating oil composition useful for lubricating a diesel engine comprising:

a base oil; and at least one isocyanate; represented by the formula:

$$R\text{-}(N{=}C{=}O)_x$$

wherein R is a hydrocarbyl group having 4 to 30 carbon atoms, and x is an integer of 1 to 4, present in amount of at least about 0.1% by weight to about 5% weight based on the lubricating oil composition.

37. The lubricating oil composition of claim 36 wherein x is 1 or 2.

38. The lubricating oil composition of claim 37 wherein the isocyanate is methylene diphenyl diisocyanate.

39. A method of operating a diesel engine comprising: an engine body; a combustion chamber formed in the engine body for containing a mixture of fuel and air; a plurality of cylinders formed in the engine body; and a respective piston mounted in each of said plurality of cylinders for reciprocal movement through successive exhaust and intake strokes, each respective piston defining a combustion chamber for containing a mixture of fuel and air the method comprising:

introducing, into the combustion chamber, diesel fuel and air;

delivering a lubricating oil composition to the cylinders;

compressing the diesel fuel in the combustion chamber to ignition with the piston thereby producing an exhaust gas;

wherein the lubricating oil composition comprises a base oil and at least one isocyanate, represented by the formula:

$$R\text{-}(N{=}C{=}O)_x$$

wherein R is a hydrocarbyl group having 4 to 30 carbon atoms, and x is an integer of 1 to 4, present in amount of at least about 0.1% by weight to about 5% weight based on the lubricating oil composition.

40. The method of claim 39 wherein x is 1 or 2.

41. The method of claim 40 wherein the isocyanate is methylene diphenyl diisocyanate.

* * * * *